US008464793B2

(12) United States Patent
Scott et al.

(10) Patent No.: US 8,464,793 B2
(45) Date of Patent: Jun. 18, 2013

(54) FLOW CONTROL SYSTEM WITH SAND SCREEN

(75) Inventors: Steven W. Scott, Stavanger (NO); Steinar Bakke, Tananger (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 254 days.

(21) Appl. No.: 12/840,922

(22) Filed: Jul. 21, 2010

(65) Prior Publication Data

US 2011/0180258 A1 Jul. 28, 2011

Related U.S. Application Data

(60) Provisional application No. 61/297,503, filed on Jan. 22, 2010, provisional application No. 61/297,525, filed on Jan. 22, 2010.

(51) Int. Cl.
*E21B 7/06* (2006.01)

(52) U.S. Cl.
USPC ..... 166/278; 166/51; 166/230

(58) Field of Classification Search
USPC ..... 166/278, 51, 227, 230, 235
See application file for complete search history.

(56) References Cited

U.S. PATENT DOCUMENTS

| | | | | |
|---|---|---|---|---|
| 4,314,129 | A | 2/1982 | Wilson et al. | |
| 5,339,895 | A * | 8/1994 | Arterbury et al. | 166/227 |
| 5,355,956 | A * | 10/1994 | Restarick | 166/296 |
| 5,404,954 | A | 4/1995 | Whitebay et al. | |
| 5,411,084 | A | 5/1995 | Padden | |
| 5,509,483 | A | 4/1996 | Graen | |
| 5,611,399 | A | 3/1997 | Richard et al. | |
| 5,624,560 | A | 4/1997 | Voll et al. | |
| 5,642,781 | A * | 7/1997 | Richard | 166/231 |
| 5,664,628 | A | 9/1997 | Koehler et al. | |
| 5,782,299 | A | 7/1998 | Simone et al. | |
| 5,823,260 | A | 10/1998 | McConnell et al. | |
| 5,849,188 | A | 12/1998 | Voll et al. | |
| 5,899,271 | A | 5/1999 | Simone et al. | |
| 5,979,551 | A | 11/1999 | Uban et al. | |
| 5,980,745 | A | 11/1999 | Voll et al. | |
| 6,092,604 | A | 7/2000 | Rice et al. | |
| 6,109,349 | A | 8/2000 | Simone et al. | |

(Continued)

FOREIGN PATENT DOCUMENTS

WO 2009108128 A1 9/2009

OTHER PUBLICATIONS

Baker Hughes, Baker Oil Tools. Excluder2000Screen. Jun. 2005. Houston, Texas, US, pp. 1-4.

(Continued)

*Primary Examiner* — William P Neuder
(74) *Attorney, Agent, or Firm* — David G. Matthews; Brandon Clark; Robert Van Someren

(57) ABSTRACT

A technique enables long-lasting control over fluid flow in a wellbore. The technique employs a base pipe, a flow control device, and a sand control screen. The sand control screen is coupled to the flow control device and mounted over the base pipe. Additionally, the sand control screen comprises longitudinal ribs positioned along the base pipe and a filter media positioned along the longitudinal ribs. A protective shroud is mounted over the filter media and cooperates with the other components of the system to provide a simple but durable system and method for controlling fluid flow.

21 Claims, 4 Drawing Sheets

U.S. PATENT DOCUMENTS

| | | | |
|---|---|---|---|
| 6,158,507 | A | 12/2000 | Rouse et al. |
| 6,305,468 | B1 | 10/2001 | Broome et al. |
| 6,382,318 | B1 | 5/2002 | Whitlock |
| 6,478,092 | B2 | 11/2002 | Voll et al. |
| 6,514,408 | B1 | 2/2003 | Simone |
| 6,516,881 | B2 | 2/2003 | Hailey, Jr. |
| 6,520,254 | B2 | 2/2003 | Hurst et al. |
| 6,607,032 | B2 | 8/2003 | Voll et al. |
| 6,619,401 | B2 | 9/2003 | Echols et al. |
| 6,715,544 | B2 | 4/2004 | Gillespie et al. |
| 6,830,104 | B2 | 12/2004 | Nguyen et al. |
| 7,497,257 | B2 | 3/2009 | Hopkins et al. |
| 7,578,344 | B2 | 8/2009 | Hopkins et al. |
| 7,588,079 | B2 | 9/2009 | Kluger et al. |
| 7,757,401 | B2 | 7/2010 | Richard et al. |
| 8,176,634 | B2 | 5/2012 | Bonner et al. |
| 2003/0173075 | A1 | 9/2003 | Morvant et al. |
| 2004/0134656 | A1 | 7/2004 | Richards |
| 2005/0086807 | A1 | 4/2005 | Richard et al. |
| 2006/0137883 | A1 | 6/2006 | Kluger et al. |
| 2008/0217002 | A1 | 9/2008 | Simonds et al. |
| 2008/0283239 | A1 | 11/2008 | Langlais et al. |
| 2008/0289815 | A1 | 11/2008 | Moen et al. |
| 2009/0078403 | A1 | 3/2009 | Langlais |
| 2010/0000742 | A1 | 1/2010 | Bonner et al. |
| 2010/0122810 | A1* | 5/2010 | Langlais ..... 166/230 |
| 2010/0258300 | A1* | 10/2010 | Shoemate ..... 166/230 |
| 2010/0319914 | A1 | 12/2010 | Dowsett et al. |
| 2011/0180257 | A1 | 7/2011 | Scott et al. |

OTHER PUBLICATIONS

Baker Hughes, Baker Oil Tools. Sand Control Screen Technologies. Dec. 2008. Houston, Texas, US, pp. 1-12.

BJ Services Company. DynaFlo DB Well Screens. Jul. 27-29, 2004. pp. 1 and 2.

Halliburton. Sand Control. PoroMax Screens. "Maximizing Performance and Value." Jul. 2005. pp. 1-2.

Halliburton. Sand Control Solutions. PoroPlus Screens. Oct. 2001. pp. 1-2.

Weatherford. Excelflo Screens. Well Screen. Jul. 2004. Houston, Texas. pp. 1-2.

Weatherford. Maxflo Screens. Well Screen. 2005-2006. Houston, Texas. pp. 1-2.

* cited by examiner

FLOW CONTROL SYSTEM WITH SAND SCREEN

CROSS-REFERENCE TO RELATED APPLICATION

The present document is based on and claims priority to U.S. Provisional Application Ser. No. 61/297,503, filed Jan. 22, 2010, and to U.S. Provisional Application Ser. No. 61/297,525, filed Jan. 22, 2010.

BACKGROUND

In many types of wells, inflowing fluid passes through a sand screen which filters out particulates from the inflowing fluid, e.g. oil or other fluid to be produced. The sand screen comprises a tubular filter media having a length significantly greater than its diameter. The tubular filter media often is constructed of a cloth type material, such as a woven wire mesh. However, this type of filter media is susceptible to damage and/or destruction. For example, fluid flow through the filter media creates a pressure difference across the filter media which can become high enough to collapse the filter media onto a base pipe. The collapsed filter media interrupts proper flow of fluid with respect to the sand control screen.

SUMMARY

In general, the present invention provides a technique for controlling flow in a wellbore. The technique employs a base pipe, a flow control device, and a sand control screen. The sand control screen is coupled to the flow control device and mounted over the base pipe. Additionally, the sand control screen comprises longitudinal ribs positioned along the base pipe and a filter media radially outward of the longitudinal ribs. A protective shroud is mounted over the filter media and cooperates with the other components of the system to provide a simple but durable system and method for controlling fluid flow.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and methodology for controlling flow in a wellbore. The system and methodology improve the ability to filter sand, e.g. particulates, from well fluid flowing into, or out of, a downhole well completion. One or more sand control screens may be positioned along the downhole well completion, and each sand control screen is coupled into cooperation with a corresponding flow control device. In one embodiment, flowing well fluid enters the sand control screen along the length of the screen via a filter media, and the fluid flow is diverted to the flow control device which may be placed at an end of the sand control screen. The flowing fluid moves through the flow control device and passes through a specifically sized orifice or other flow control device which is able to control the rate of flow. In other applications, the flow direction may be reversed so that flow through an interior base pipe exits through the flow control device and is then distributed along sand screen flow channels before exiting over the length of the sand screen via the filter media. The sand control screen is designed to provide substantial support for the filter media, and thus to prevent collapse or other damage to the filter media.

According to one embodiment, the sand control screen is mounted around an interior base pipe and comprises a plurality of longitudinal ribs extending along an unperforated, exterior surface of the base pipe to the flow control device. A wire is wrapped transversely about the plurality of longitudinal ribs to secure the plurality of longitudinal ribs with respect to the base pipe. A filter media is disposed over the transversely wrapped wire. Additionally, an outer, protective shroud may be disposed around the filter media to provide a combination of components which enables long-term use of the sand screen without collapse.

In some applications, the filter media is formed of a cloth type material, such as a woven wire mesh. However, the present system and methodology are able to provide substantial support for wire mesh filter media, and for a variety of relatively weak filter media, to maintain functioning flow channels between the filter media and the internal base pipe. According to one embodiment, a tight fit between the longitudinal ribs of the sand control screen and the internal base pipe further improves the strength of the sand screen to prevent deformation and/or collapse of the filter media in the event a pressure differential develops across the filter media due to plugging.

Figure 1:
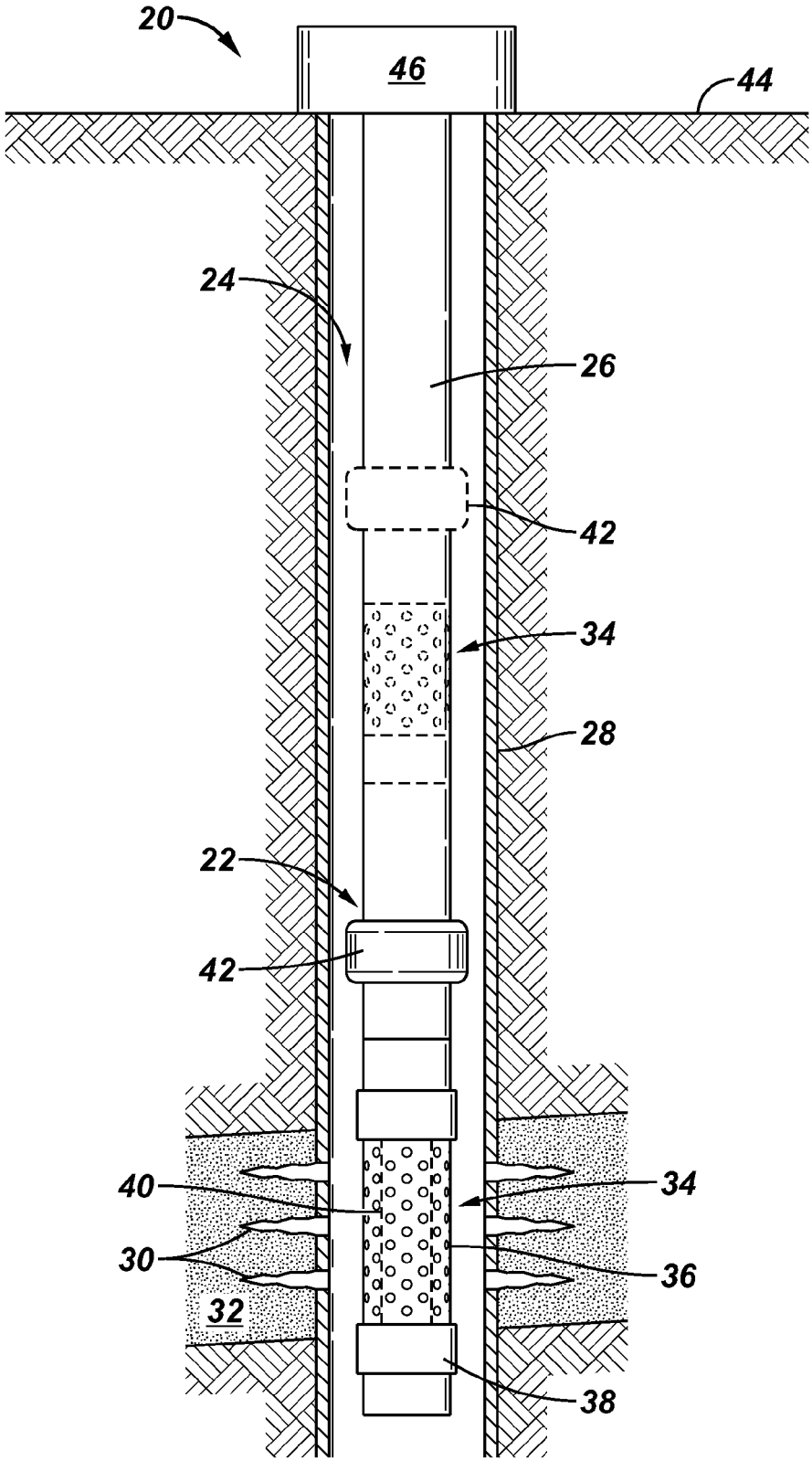
FIG. 1 is a schematic illustration of one example of a flow control system deployed in a wellbore, according to an embodiment of the present invention.

Referring generally to FIG. 1, one example of a well system 20 for controlling flow of fluids in a downhole environment is illustrated schematically. In this example, well system 20 comprises well equipment 22, e.g. a well completion, deployed downhole into a wellbore 24. The well equipment 22 may be deployed downhole via a conveyance 26, such as coiled tubing, production tubing, or another suitable conveyance. Depending on the specific application, wellbore 24 may be cased or lined with a casing 28 having perforations 30 to enable fluid communication between a surrounding formation 32 and the wellbore 24.

Well equipment 22 may include many types of devices, components and systems. For example, the well equipment may comprise a variety of artificial lift systems, sensor systems, monitoring systems, and other components designed to facilitate production operations, servicing operations, and/or other well related operations. In the example illustrated, well equipment 22 further comprises a fluid flow control assembly 34.

The fluid flow control assembly 34 comprises a sand control screen 36 coupled to a flow control device 38. Both the sand control screen 36 and the flow control device 38 may be mounted over a base pipe 40. Additionally, the well equipment 22 may comprise one or more isolation devices 42, e.g. packers, positioned to enable selective isolation of a specific well zone associated with the fluid flow control assembly 34. It should be noted that well equipment 22 also may comprise additional fluid flow control assemblies 34 (see additional assembly shown in dashed lines) and isolation devices 42 to isolate and control fluid flow from, or into, other well zones.

In FIG. 1, wellbore 24 is illustrated as a generally vertical wellbore extending downwardly from a surface location 44. Additionally, well equipment 22 is illustrated as deployed downhole into the generally vertical wellbore 24 beneath surface equipment 46, such as a wellhead. However, the design of wellbore 24, surface equipment 46, and other components of well system 20 can be adapted to a variety of environments. For example, wellbore 24 may comprise a deviated, e.g. horizontal, wellbore or a multilateral wellbore extending from surface or subsea locations. The well equipment 22 also may be designed for deployment into a variety of vertical and deviated wellbores drilled in a variety of environments.

Figure 2:
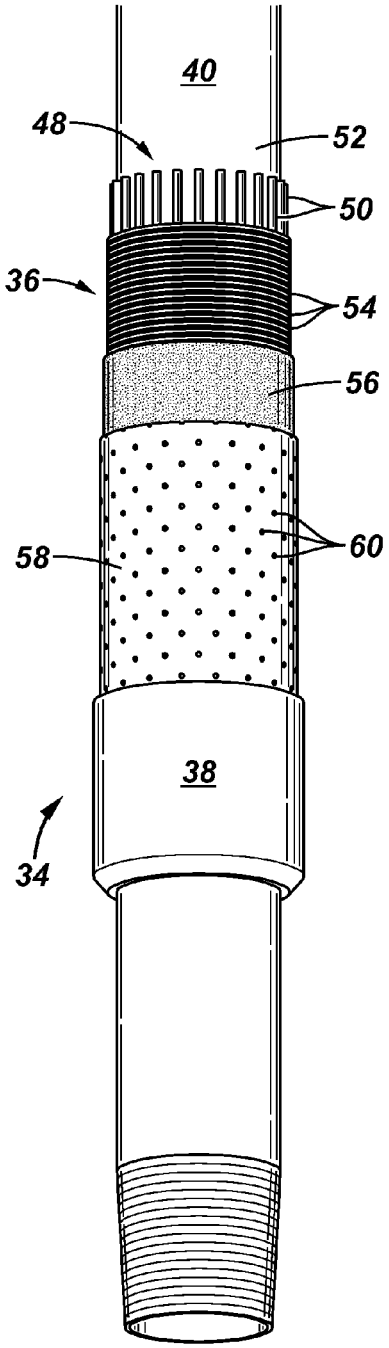
FIG. 2 is an orthogonal view of one example of a sand control screen coupled with a flow control device, according to an embodiment of the present invention.

Referring generally to FIG. 2, one embodiment of fluid flow control assembly 34 is illustrated. In this embodiment, sand control screen 36 is coupled with flow control device 38 and mounted over base pipe 40. The sand control screen 36 may have a length dimension substantially greater than its diameter. In the example illustrated, a filter media support layer 48 comprises a plurality of longitudinal ribs 50 which are disposed along an unperforated portion 52 of base pipe 40. The plurality of longitudinal ribs 50 is secured in position around the base pipe 40 by a wire 54 which may be wrapped transversely around the plurality of longitudinal ribs 50. In one example, wire 54 is helically wrapped around the longitudinal ribs 50. Furthermore, wire 54 may be wrapped over the longitudinal ribs in a manner that secures the longitudinal ribs directly against an outer surface of the base pipe 40. By securing longitudinal ribs 50 directly against base pipe 40, the sand control screen 36 and the flow control device 38 may be securely mounted on base pipe 40 without welding the sand control screen 36 or the flow control device 38 to the base pipe 40.

A filter media 56 is disposed around the longitudinal ribs 50 of support layer 48. By way of example, the filter media 56 may comprise a cloth material, such as a woven wire cloth, although other types of filter media may be employed. In some embodiments, filter media 56 is deployed directly against wire 54, although one or more standoff layers may be positioned between wire 54 and filter media 56, as discussed in greater detail below. The filter media 56 may be formed into a tubular element sized to fit closely over the outside diameter of the transversely wrapped wire 54.

Additionally, a protective shroud 58 may be disposed around filter media 56 to protect the filter media while still allowing flow of fluid therethrough. In one example, protective shroud 58 is a metal tube having multiple openings/perforations 60 to facilitate inflow, or outflow, of fluid. The outer, protective shroud 58 may be tightly positioned around and against filter media 56, although other embodiments employ one or more standoff layers between the filter media 56 and the protective shroud 58, as discussed in greater detail below.

Figure 3:
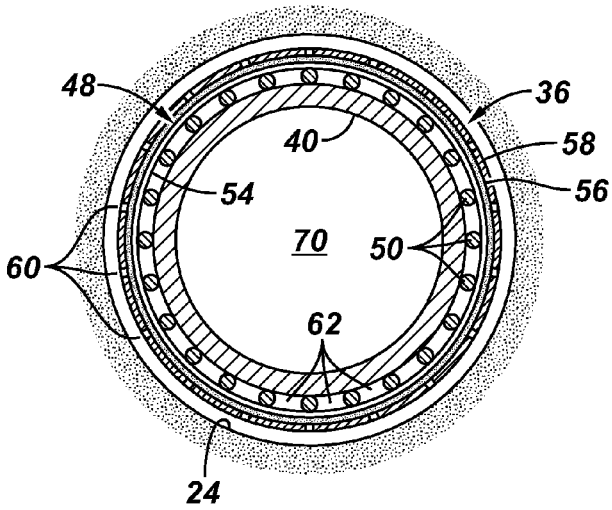
FIG. 3 is a cross-sectional view of one example of a sand screen having axial flow channels, according to an embodiment of the present invention.

Referring generally to FIG. 3, a cross-sectional view of the sand control screen embodiment of FIG. 2 is illustrated. The cross-sectional view shows a plurality of flow channels 62 which are created between longitudinal ribs 50. In the embodiment illustrated, flow channels 62 are oriented generally in an axial direction to enable axial flow of fluid along the space between filter media 56 and the unperforated portion 52 of base pipe 40. The spacing between adjacent longitudinal ribs 50, as well as the spacing between adjacent wraps of wire 54, is greater than the pore size of the filter media. If, for example, the filter media 56 comprises woven wire, the spaces or pores through the woven wire are selected to restrict particles of smaller size than would be restricted by the spacing between longitudinal ribs 50 or between the wraps of wire 54.

Figure 4:
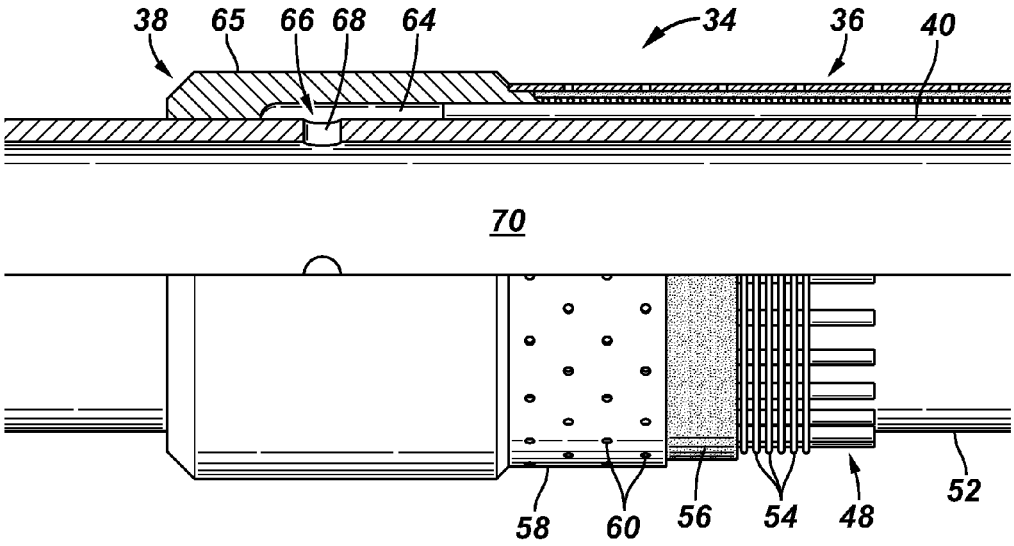
FIG. 4 is a partially broken away view of one example of a flow control device coupled with a sand screen, according to an embodiment of the present invention.

In FIG. 4, one example of the flow control device 38 is illustrated as coupled with sand control screen 36. In this embodiment, the flow control device 38 and sand control screen 36 are mounted in position over base pipe 40 without forming any welds between the flow control device 38 and the base pipe 40. Similarly, no welds are employed between the sand control screen 36 and the base pipe 40. As illustrated, the flow control device 38 is joined to the multiple layers of sand control screen 36. For example, flow control device 38 may be welded or otherwise secured to an axial end of the longitudinal ribs 50 of support layer 48. However, the flow control device 38 also may be welded or otherwise secured to alternate or additional layers, e.g. filter media 56 and protective shroud 58, of sand control screen 36. The entire system being held in place on the base pipe by the tight fit caused by wrapping wire 54 over longitudinal ribs 50.

The flow control device 38 is designed to control flow from/to the support layer flow channels 62 and into/out of a flow chamber 64 defined by a flow control device housing 65. For example, well fluid flowing into wellbore 24 from formation 32 flows through protective shroud 58, through filter media 56, and into flow channels 62 which direct the flowing fluid to flow chamber 64 of flow control device 38. Flow control device 38 further directs the flow of fluid from flow chamber 64 through a flow control member 66, such as an orifice 68. The flow control member 66 then directs the inflow of fluid to enter interior 70 of base pipe 40. In some applications, however, fluid may be reverse flowed down through interior 70, out through orifice 68, and along flow channels 62 for discharge and distribution along sand control screen 36.

Flow control member 66 may comprise a nozzle, a tube, or other types of devices designed to provide a desired control over the flowing fluid. The flow control member 66 is selected to provide a controlled pressure drop as a function of fluid properties and fluid flow rate through or across the sand control screen 36. In many applications, this control over inflow of well fluid enables better management of a hydrocarbon reservoir or of other types of reservoirs. Consequently, greater quantities of desired fluid may be produced from a given well or well zone.

Figure 5:
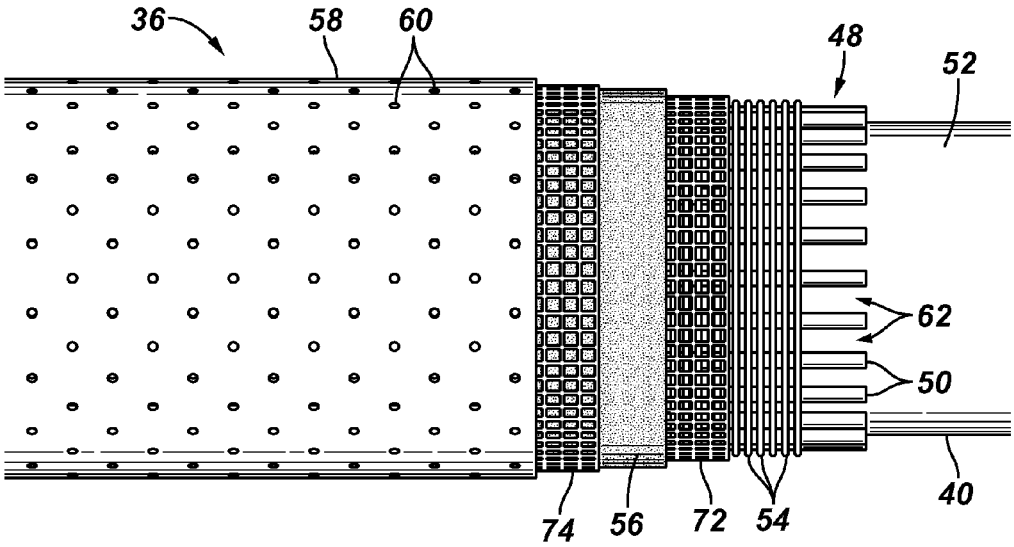
FIG. 5 is a view of a portion of a sand screen illustrating various layers of the sand screen, according to an embodiment of the present invention.

Referring generally to FIG. 5, an alternate embodiment of sand control screen 36 is illustrated. In this embodiment, a standoff layer 72 is positioned between transversely wrapped wire 54 and filter media 56. The standoff layer 72 may be formed as a mesh layer with pore openings significantly larger than the pore openings of filter media 56. Layer 72 provides extra standoff between layers to facilitate flow of fluid in an axial direction between layers of the screen, e.g. between support layer 48 and filter media 56. Additionally, or in the alternative, another standoff layer 74 may be positioned between layers of sand control screen 36. For example, the second standoff layer 74 may be located between filter media 56 and protective shroud 58. Similar to standoff layer 72, layer 74 may be formed as a mesh layer with pore openings significantly larger than the pore openings of filter media 56. Layer 74 also provides extra standoff between layers to facilitate flow of fluid in an axial direction between layers of the screen, e.g. between filter media 56 and protective shroud 58.

Figure 6:
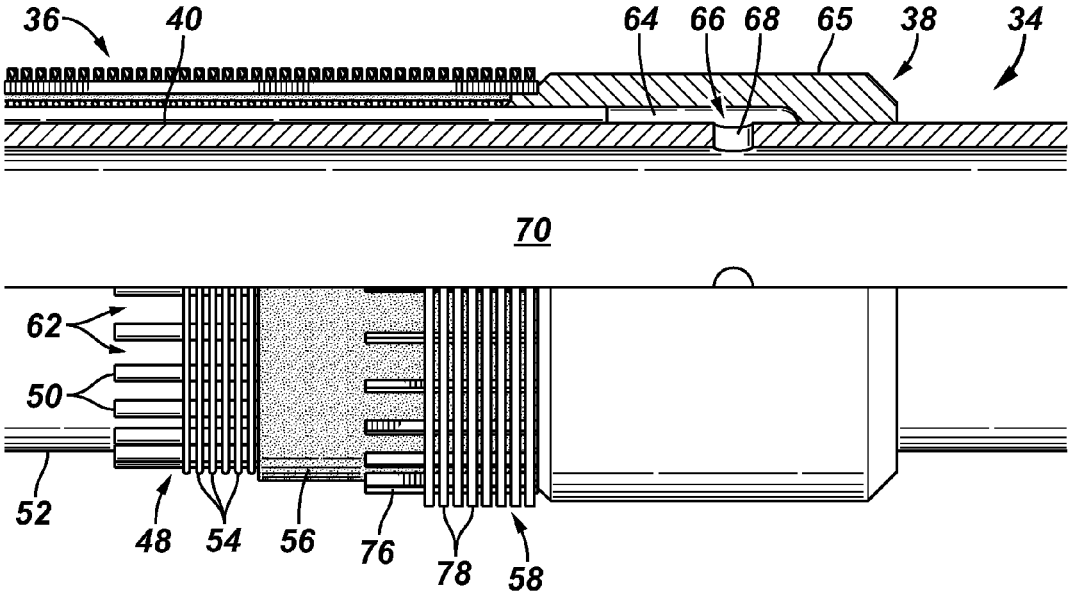
FIG. 6 is a partially broken away view of an alternate example of a sand control screen coupled with a flow control device, according to an embodiment of the present invention.
Figure 7:
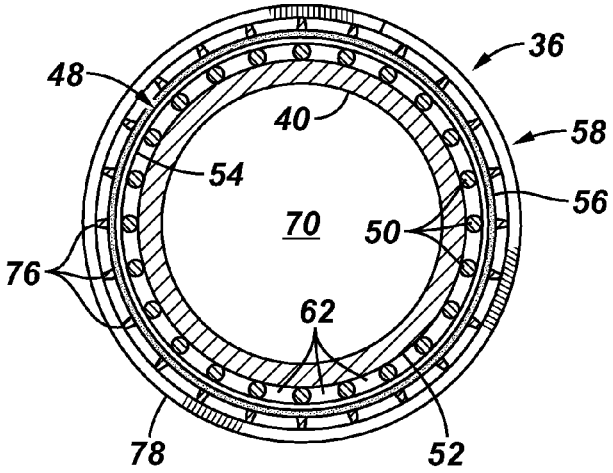
FIG. 7 is a cross-sectional view of the sand control screen illustrated in FIG. 6, according to an embodiment of the present invention.

In FIGS. 6 and 7, another embodiment of sand control screen 36 is illustrated in cooperation with flow control device 38. In this embodiment, protective shroud 58 is formed with a series of axial ribs 76 which are oriented in a generally axial direction along an exterior surface of filter media 56. The plurality of axial ribs 76 is bound together by a transversely wrapped wire 78, such as a helically wrapped wire, around the axial ribs 76.

The alternate protective shroud 58 may be constructed in a manner similar to support layer 48 by laying axial ribs 76 directly onto the outside surface of filter media 56. Wire 78 is then wrapped around the axial ribs 76 in a transverse direction to secure the axial ribs 76, as illustrated in FIG. 7. Alternatively, the outer, protective shroud 58 may be manufactured as a jacket which provides a radial gap along the filter media 56 to allow the protective shroud 58 to be slid over the filter media outside diameter. The spacing between axial ribs 76 and between wraps of wire 78 is greater than the pore size of filter media 56 to ensure that filtration takes place in the filter media 56 rather than along the outer surface of protective shroud 58.

Depending on the objectives of the downhole flow control, the various fluid flow control assembly components may be made in a variety of configurations. For example, the outer, protective shroud 58 may comprise a wire wrapped shroud, a direct wrap shroud, or a perforated metal shroud having holes of a variety of shapes and designs, e.g. round or louvered. Additionally, the wires 54, 78 and ribs 50, 76 may have a variety of sizes and cross-sectional shapes. As illustrated in the cross-sectional view of FIG. 7, the ribs 50, 76 may have circular cross-sectional shapes, triangular cross-sectional shapes, delta cross-sectional shapes, or other suitable cross-sectional shapes.

The overall well system 20 may be designed to accommodate a variety of flow control applications in a variety of well environments. Accordingly, the number, type and configuration of components and systems within the overall system may be adjusted to accommodate different applications. For example, the size, number and configuration of the sand control screens can vary. Additionally, the flow control features of flow control device 38 may be adjusted according to the characteristics of the fluid and the environment. The sand control screen and/or flow control device may be attached to the base pipe by frictional engagement with the support layer, e.g. forming an interference fit between the longitudinal ribs and the base pipe, to avoid the need for welding onto the base pipe. However, a variety of other attachment techniques may be employed to enable placement of the fluid flow control assembly without the need for welding to the internal base pipe. Additionally, the types and arrangements of other downhole equipment used in conjunction with the one or more fluid flow control assemblies may be selected according to the specific well related application in which the flow control system and technique are to be utilized.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for controlling flow in a wellbore, comprising:
- a base pipe having a flow control device housing positioned around the pipe;
- an orifice extending through a sidewall of a section of the base pipe covered by the flow control device housing; and
- a sand control screen positioned around the base pipe and engaged with the flow control device housing, the sand control screen comprising:
  - a plurality of longitudinal ribs extending along the base pipe to the flow control device housing;
  - a wire transversely wrapped about the plurality of longitudinal ribs to secure the plurality of longitudinal ribs directly onto an outer surface of the base pipe;
  - a filter media positioned over the wire; and
  - an outer protective shroud,
- wherein the flow control device housing is secured to the sand control screen without being welded to the base pipe, wherein the flow control device housing is welded to axial ends of the plurality of longitudinal ribs.

2. The system as recited in claim 1, wherein a spacing between adjacent wire wraps of the transversely wrapped wire is greater than the pore size of the filter media.

3. The system as recited in claim 1, wherein the filter media comprises a woven material.

4. The system as recited in claim 1, wherein the outer protective shroud comprises a perforated tube.

5. The system as recited in claim 1, wherein the sand control screen is positioned along a substantially unperforated portion of the base pipe.

6. A system for controlling flow in a wellbore, comprising:
- a base pipe having a flow control device housing positioned around the pipe;
- an orifice extending through a sidewall of a section of the base pipe covered by the flow control device housing; and
- a sand control screen positioned around the base pipe and engaged with the flow control device housing, the sand control screen comprising:
  - a plurality of longitudinal ribs extending along the base pipe to the flow control device housing;
  - a wire transversely wrapped about the plurality of longitudinal ribs to secure the plurality of longitudinal ribs directly onto an outer surface of the base pipe;
  - a filter media positioned over the wire; and
  - an outer protective shroud,
- wherein the flow control device housing is secured to the sand control screen without being welded to the base pipe, wherein the sand control screen further comprises a standoff layer between the wire transversely wrapped and the filter media.

7. The system as recited in claim 6, wherein the standoff layer is a mesh layer.

8. The system as recited in claim 6, wherein the sand control screen further comprises an additional mesh layer positioned between the filter media and the outer protective shroud.

9. The system as recited in claim 6, wherein a spacing between adjacent wire wraps of the transversely wrapped wire is greater than the pore size of the filter media.

10. The system as recited in claim 6, wherein the filter media comprises a woven material.

11. The system as recited in claim 6, wherein the outer protective shroud comprises a perforated tube.

12. The system as recited in claim 6, wherein the sand control screen is positioned along a substantially unperforated portion of the base pipe.

13. A system for controlling flow in a wellbore, comprising:

a base pipe having a flow control device housing positioned around the pipe;

an orifice extending through a sidewall of a section of the base pipe covered by the flow control device housing; and a sand control screen positioned around the base pipe and engaged with the flow control device housing, the sand control screen comprising:

a plurality of longitudinal ribs extending along the base pipe to the flow control device housing;

a wire transversely wrapped about the plurality of longitudinal ribs to secure the plurality of longitudinal ribs directly onto an outer surface of the base pipe;

a filter media positioned over the wire; and an outer protective shroud, wherein the flow control device housing is secured to the sand control screen without being welded to the base pipe, wherein the sand control screen further comprises an additional mesh layer positioned between the filter media and the outer protective shroud.

14. The system as recited in claim 13, wherein a spacing between adjacent wire wraps of the transversely wrapped wire is greater than the pore size of the filter media.

15. The system as recited in claim 13, wherein the filter media comprises a woven material.

16. The system as recited in claim 13, wherein the outer protective shroud comprises a perforated tube.

17. The system as recited in claim 13, wherein the sand control screen is positioned along a substantially unperforated portion of the base pipe.

18. A system for controlling flow in a wellbore, comprising:

a base pipe;

a flow control device; and a sand control screen coupled to the flow control device and mounted over the base pipe, the sand control screen comprising:

a plurality of longitudinal ribs positioned against an outer surface of the base pipe;

a filter media radially outward of the plurality of longitudinal ribs; and a protective shroud mounted over the filter media, the protective shroud comprising a plurality of axial ribs bound together by an independent wire wrapped over an exterior of the plurality of axial ribs to secure the plurality of axial ribs in place.

19. The system as recited in claim 18, wherein the base pipe is substantially unperforated beneath the sand control screen.

20. The system as recited in claim 18, wherein the flow control device is welded to the sand control screen but not to the base pipe.

21. The system as recited in claim 18, wherein the plurality of longitudinal ribs is held against the base pipe by a transversly wrapped wire.

* * * * *